US009115321B2

(12) United States Patent
Schwarz et al.

(10) Patent No.: US 9,115,321 B2
(45) Date of Patent: Aug. 25, 2015

(54) GASIFICATION DEVICE AND METHOD

(75) Inventors: Armin Schwarz, Vechta (DE); Mario Urra Saco, Vechta (DE)

(73) Assignee: BIG DUTCHMAN INTERNATIONAL GMBH, Vechta (DE)

( * ) Notice: Subject to any disclaimer, the term of this patent is extended or adjusted under 35 U.S.C. 154(b) by 359 days.

(21) Appl. No.: 13/579,421

(22) PCT Filed: Feb. 16, 2010

(86) PCT No.: PCT/EP2010/051947

§ 371 (c)(1),
(2), (4) Date: Oct. 24, 2012

(87) PCT Pub. No.: WO2011/101022

PCT Pub. Date: Aug. 25, 2011

(65) Prior Publication Data

US 2013/0097928 A1 Apr. 25, 2013

(51) Int. Cl.

| | |
|---|---|
| ***C10J 3/72*** | (2006.01) |
| ***C10J 3/06*** | (2006.01) |
| ***C10J 3/26*** | (2006.01) |

(Continued)

(52) U.S. Cl.

CPC .. *C10J 3/721* (2013.01); *C10J 3/06* (2013.01); *C10J 3/26* (2013.01); *C10J 3/32* (2013.01); *C10J 3/40* (2013.01); *C10J 3/64* (2013.01); *C10J 2200/152* (2013.01); *C10J 2300/0956* (2013.01); *C10J 2300/1606* (2013.01); *C10J 2300/1609* (2013.01); *C10J 2300/1846* (2013.01)

(58) Field of Classification Search

CPC combination set(s) only.
See application file for complete search history.

(56) References Cited

U.S. PATENT DOCUMENTS 5,026,403 A * 6/1991 Michel-Kim ..... 48/203
5,435,890 A * 7/1995 Munger ..... 202/93

(Continued)

FOREIGN PATENT DOCUMENTS

CN 1286759 3/2001
CN 101558133 10/2009

(Continued)

OTHER PUBLICATIONS

Russian Patent Office Action (with translation), Russian Patent Appln. No. 2012139452 (dated Feb. 16, 2010), for Applicant: Big Dutchman International GmbH (dated May 12, 2014).

(Continued)

*Primary Examiner* — Kaity Handal
(74) *Attorney, Agent, or Firm* — Price Heneveld LLP

(57) ABSTRACT

The invention concerns a gasification device for the creation of a flammable gas from a solid, comprising a gasification zone, in which the solid can be filled through a fill opening, an oxidation zone for the oxidation of the resulting gas, which is connected to the gasification zone to conduct the gas created in the gasification zone into the oxidation zone. According to the invention, the efficiency of the gasification device is improved in that the gasification zone is divided into several neighboring gasification sectors, a temperature metering unit is present that is configured to measure the temperature prevailing in each gasification sector, and the temperature metering unit is coupled by signal technology to a control unit, which is coupled to an air supply device by signal technology, that is designed to supply air individually to each gasification sector, and the amount of air supplied to each gasification sector per unit of time is dependent on the temperature measured therein.

12 Claims, 3 Drawing Sheets

Figure 1:
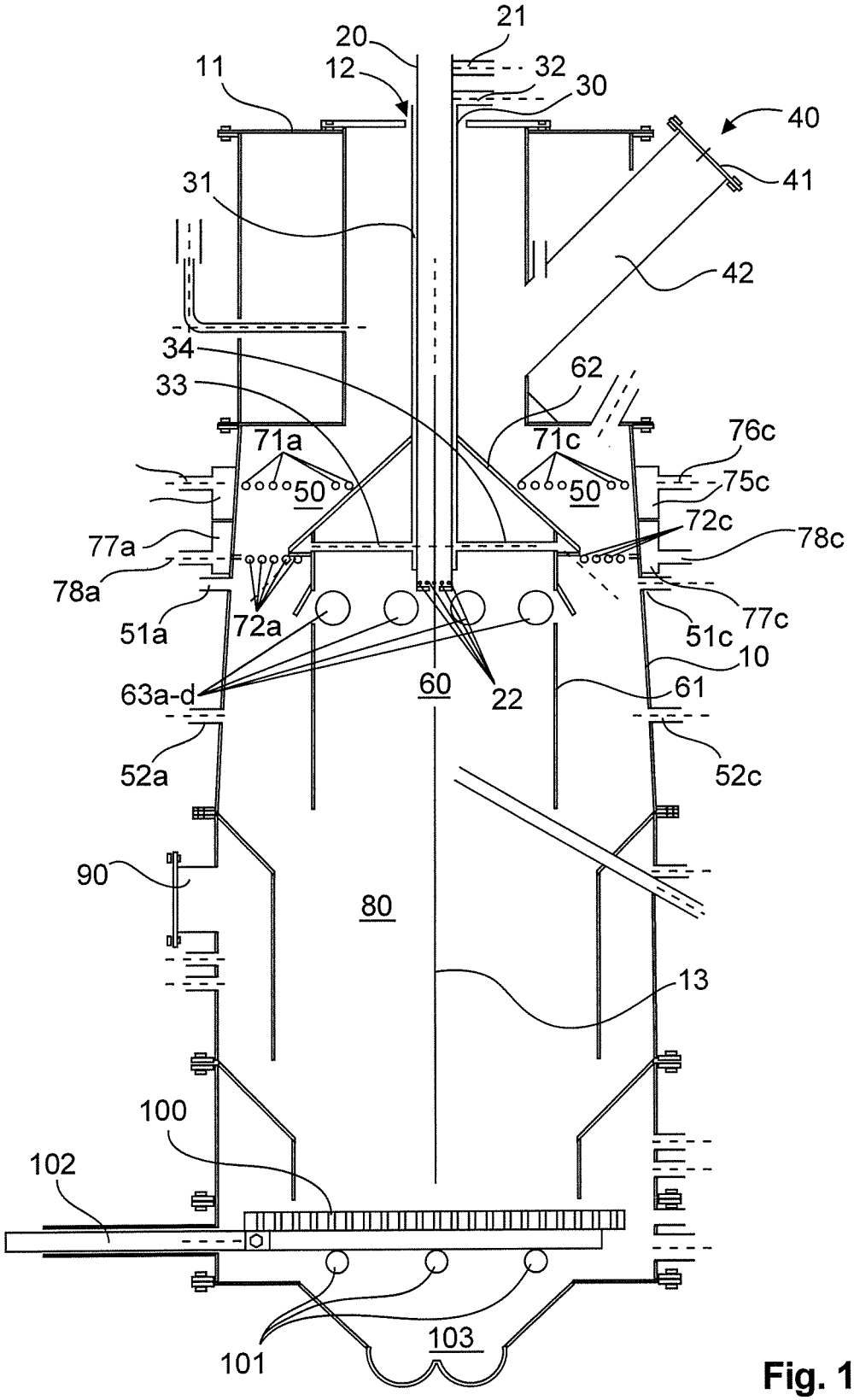

(51) Int. Cl.

| | |
|---|---|
| ***C10J 3/40*** | (2006.01) |
| ***C10J 3/32*** | (2006.01) |
| ***C10J 3/64*** | (2006.01) |

(56) References Cited

U.S. PATENT DOCUMENTS

| | | | |
|---|---|---|---|
| 7,819,070 | B2 | 10/2010 | Rehmat |
| 2007/0006528 | A1 | 1/2007 | Diebold et al. |
| 2007/0012229 | A1 | 1/2007 | Rehmat |
| 2009/0260286 | A1 | 10/2009 | Sasauchi et al. |
| 2009/0282738 | A1 | 11/2009 | Tharpe, Jr. |

FOREIGN PATENT DOCUMENTS

| | | |
|---|---|---|
| DE | 1 037 051 | 8/1958 |
| DE | 19846805 | 4/2000 |
| DE | 10258640 | 6/2004 |
| DE | 202006009174 | 11/2007 |
| DE | 102010033646 | 8/2011 |
| EP | 0693539 | 1/1996 |
| EP | 1207190 | 5/2002 |
| EP | 1207191 | 5/2002 |
| EP | 1462505 | 9/2004 |
| EP | 1865046 | 12/2007 |
| EP | 2 281 864 | 8/2009 |
| FR | 2965816 | 4/2013 |
| JP | 2000505123 | 4/2000 |
| WO | 9923431 | 5/1999 |
| WO | 0151591 | 7/2001 |
| WO | 0240618 | 5/2002 |
| WO | 0246332 | 6/2002 |
| WO | 2006128285 | 12/2006 |
| WO | 2007002844 | 1/2007 |
| WO | 2008059109 | 5/2008 |
| WO | 2008145814 | 12/2008 |
| WO | 2009020442 | 2/2009 |
| WO | 2011101022 | 8/2011 |

OTHER PUBLICATIONS

International Search Report, Appln No. PCT/EP2013/002765, Big Dutchman International GmbH (Jan. 21, 2014) (German language only).

International Search Report, Appln. No. PCT/EP2010/051947 (Apr. 18, 2011).

Written Opinion Appln. No. PCT/EP2010/051947 (May 14, 2012).

Preliminary Report, Appln. No. PCT/EP2010/051947 (Jul. 2, 2012).

State Intellectual Property Office (SIPO) Office Action in Chinese Patent Application for Invention No. 201080066246.9 (PCT/EP2010/051947), in the name of Big Dutchman International GmbH, dated Jul. 8, 2013.

Japanese Patent Office Action, Japanese Patent Appln. No. 2012-553193, for Applicant: Big Dutchman International GmbH (Apr. 1, 2014) (with summary translation only).

* cited by examiner

GASIFICATION DEVICE AND METHOD

The invention concerns a gasification device for the creation of a flammable gas from a solid, comprising:

a gasification zone, in which the solid can be filled through a fill opening, an oxidation zone is formed for the oxidation of the resulting gas, which is connected to the gasification zone to conduct the gas created in the gasification zone into the oxidation zone.

Another aspect of the invention is a gasification method for generating a flammable gas from a solid.

Gasification devices or gasifiers or gas generators of the mentioned kind and gasification method are used to gasify solid substances, such as organic or inorganic, carbon-containing materials, especially wood, plants or plant residues, especially in pelleted form, as completely as possible in a controlled process, so as to generate in this way an ignitable and especially a burnable gas. Typically this gas thus generated is burned in a process initiated after the gasification, so as to perform work and, for example, drive a current generator.

A gasifier and a gasification method are known from EP 1 865 046 A1, which produces a flammable gas in a three-stage process in a shaft gasifier by gasification of the solid, partial oxidation and thermal splitting of the gas and reduction. The disclosure of this patent application is incorporated completely by reference in the disclosure of EP 1 865 046 A1. The drawback to the prior art disclosed in this patent application is that the gasification often occurs only incompletely and thus the amount of energy present in the solid is not completely utilized. A further drawback of such previously known process or gasifier is that the gasifier, when operating as intended, has a tendency to fouling and therefore relatively short maintenance intervals are needed for its regular cleaning.

Further gasification methods and gasifiers are known from DE 1 037 051, DE 198 46 805 and DE 102 58 640 for gasifying solids into a flammable gas. These previously known methods also have the drawback of not fully utilizing the amount of energy latent in the solid in the form of a flammable gas, since the gasification process in them does not run in an optimal fashion and a regular maintenance at short intervals of time is required in order to ensure the functionality of the gasifier and the effectiveness of the gasification process.

The problem of the present invention is to provide a gasifier and a gasification method that achieves a more efficient gasification of the solid. One goal of the invention is to extend the time intervals between two necessary maintenance intervals during intended use of the gasification device as compared to the prior art for the same efficiency, or to at least maintain and preferably extend them for heightened efficiency.

This problem is solved according to the invention in that the gasification zone is divided into several neighboring gasification sectors, a temperature metering unit is present that is configured to measure the temperature prevailing in each gasification sector, and the temperature metering unit is coupled by signal technology to a control unit, which is coupled by signal technology to an air supply device that is designed to supply air individually to each gasification sector, and the amount of air supplied to each gasification sector per unit of time is dependent on the temperature measured therein.

With the gasification device of the invention, a gasification zone is provided that is functionally divided in terms of temperature management and air supply into at least two, preferably more than two gasification sectors. A functional division can be accomplished, for example, by separating the gasification sectors from each other not by structural elements, but rather a separate air supply is provided for each gasification sector and the gasification sector is supplied with air essentially, or at least in a critical fraction for the temperature management, from the air supply provided for it. Thus, a gasification zone can be provided that is still contiguous on the whole and not structurally divided, yet because of the separate air supply, it is functionally divided into defined gasification sectors. In addition, the gasification zone can also be divided by separating elements such as partition walls or the like, so that a passage of solid and gas from one gasification sector into another gasification sector is not directly possible, especially not by direct pathway, so that the gasification process takes place as a largely isolated process in each gasification sector.

According to the invention, the temperature prevailing in each gasification sector is detected there. For this, a corresponding temperature metering device is present, which measures the temperature of the individual gasification sectors, for example by means of an individual temperature metering instrument, in successive metering cycles, or which comprises several temperature metering devices and coordinates each temperature metering device with a gasification sector.

The temperature metering device is coupled by signal technology to a control unit that serves to adjust the temperature in each gasification sector in an optimal region for the gasification. It is to be understood that the control device can regulate in particular a closed control process in a control circuit. The control device, in turn, is coupled by signal technology to an air supply unit which is designed to supply air to each gasification sector. It is possible to supply an ideal amount of air to each gasification sector for the conditions prevailing in this gasification sector or in certain situations no air is supplied. Essentially, in the case that too low a temperature prevails in a gasification sector, i.e., a temperature below the ideal process temperature, a supply of air or an increased supply of air by the air supply device should be provided, and in the opposite case, i.e., when the temperature is too high or above the ideal process temperature in a gasification sector, the air supply to this gasification sector should be reduced.

Instead of a temperature metering unit, according to the invention a different detecting device can be used, enabling a direct or indirect inference as to the efficiency of the gasification process in the particular sector, for example, an analysis device for determining the composition of the pyrolysis gas or portions thereof.

With the modified gasification device of the invention, one accomplishes a gasification of a solid in a large gasification zone, without the drawback of an unfavorable gasification occurring due to locally conditioned effects, such as an accumulation of especially large and dense quantities of solid in one region of the gasification zone or an unfavorable air supply to one region of the gasification zone. This is accomplished according to the invention in that the gasification zone is divided into at least two, preferably more sectors, such as four gasification sectors, each extending over a peripheral segment of 90°, and the gasification is controlled or regulated separately by means of the temperature prevailing therein and its regulation or control by air supply in each gasification sector. Essentially, the gasification sectors can be distributed evenly or unevenly about the periphery and one can provide two, three, four, five or more sectors.

By means of a first preferred embodiment, the oxidation zone is surrounded in regard to its cross section at least partly, preferably completely, by the gasification zone. According to this embodiment, the oxidation zone is arranged centrally within the gasification device in that it is surrounded in regard to a cross section by the gasification device, at least in one region but preferably entirely by the gasification zone. In this way, in particular, an annular gasification zone is formed about the oxidation zone and consequently an effective heat transfer from the gasification zone into the oxidation zone and vice versa is made possible. It is to be understood, on the one hand, that a convective heat transport occurs from the gasification zone into the oxidation zone thanks to the supply of pyrolysis gas, by the surrounding of the oxidation zone by the gasification zone, but also in addition a heat transport can occur through direct thermal conduction. In particular, this embodiment can be realized such that the gasification device is designed as a shaft gasifier and the oxidation zone is configured as an oxidation chamber arranged centrally inside the shaft gasifier, being surrounded by an annular gasification zone.

Furthermore, it is preferable to modify the gasification device of the kind described at the outset or above by an air supply pipe which is connected at its first end to the oxidation zone, in particular, it protrudes into the oxidation zone, and it is connected by its other end to a source of oxygen-containing air. This modification can be realized both in connection with the above-explained gasification zone divided into several adjacent gasification sectors and the associated temperature metering unit, control unit and air supply device or also independently and without such a partitioned gasification zone, temperature metering unit, control unit and/or air supply device. Thanks to the air supply pipe, air can be supplied in effective manner to the oxidation zone in order to carry out or force the oxidation of the pyrolysis gas there. The air supply pipe extends preferably from an upper end of the gasification device in the lengthwise direction, especially along the center axis of the gasification device, downward in the direction of the oxidation zone.

It is further preferable for the air supply pipe to be arranged at least partially in a sheathing pipe and to form an annular space between the air supply pipe and the sheathing pipe, which is connected at its first end to the gasification zone and connected by its other end to a source of oxygen-containing air.

Thanks to such a sheathing pipe, it becomes possible to supply further air with the oxygen contained therein to another region, in particular, to the gasification zone, in addition to the air that is supplied through the air supply pipe to the oxidation zone. This modification is based on the knowledge that, when it is desired to subject solids to an efficient gasification, it is advantageous for the air supply to occur in a uniform and balanced way, i.e., avoiding high local flow velocities, but at the same time providing a sufficiently high flow volume to achieve the most complete and efficient gasification possible. It has proven to be especially advantageous to introduce the air through several supply sources and lines in this case. Basically, as described in the prior art, the air needed for the gasification can be supplied to the gasification zone from the outside, for example, through several air supply pipes or nozzles projecting from the outside into the gasification zone. But especially when the gasification zone extends over such a cross section that parts of the cross section at a distance from this air supply from the outside also need to achieve an efficient gasification, it is advantageous to provide another air supply, emerging in the vicinity of these cross section regions. This can be done effectively by the sheathing pipe. The sheathing pipe can essentially be arranged so that it runs inside the gasification device, in particular, when the gasification device is configured as a shaft gasifier, along and parallel with, preferably coaxially with the longitudinal axis of the shaft gasifier. In this way, it becomes possible to bring air into a central region of the gasification zone, especially in that region of the gasification zone bordering directly on the oxidation zone.

It is to be understood that when the gasification zone is divided into several gasification sectors, the sheathing pipe is also configured such that it has separate air supply lines, in particular, in the same number as the number of gasification sectors, so as to individually adapt the air conveyed by the annular space between sheating pipe and air supply pipe to the requirements in each gasification sector. This can be accomplished, for example, by radially extending partition walls, by which the annular space is divided into several sectors of the annular space and these sectors are individually supplied with an air flow.

Essentially, moreover, it is to be understood by the term "air" in particular the ambient air, but also gases or gas mixtures that differ from the composition of the ambient air, especially gas mixtures that contain an increased fraction of oxygen, for example, or gas mixtures to which fractions are added that act as a catalyst or that contain particular gasification or oxidation promoting fractions that prevent deposits from building up inside the gasification device. These fractions can involve, in particular, gaseous fractions. Furthermore, however, the fractions can also be added in liquid form, such as the form of an aerosol, or in solid form, such as the form of a powder. In particular, the air supplied can be enriched with water or steam in certain process situations in order to advantageously influence the pyrolysis and gasification or oxidation or, as explained below, reduction.

According to another preferred embodiment of the gasification device explained at the outset or above, the oxidation zone is arranged in an oxidation chamber, which is bounded by one or more walls, in particular, it is bounded off from the gasification zone, and at least segments of these walls, preferably all the walls, are designed movable in relation to the gasification zone, in particular, able to rotate. It is to be understood that this modification can be configured in combination with the above explained dividing of the gasification zone into gasification sectors and with the temperature metering unit, as well as the control unit and/or the air supply device, or without this division and these units or devices, i.e., it constitutes an independent modification of the gasification device of the design explained at the outset.

By the option of this modification to move the walls at least in part, but especially in their entirety, a relative movement is accomplished between the solids placed in the gasification device and the moving walls, so that the buildup of a layer of solids on these walls, such as by deposits from the pyrolysis gases, can be effectively prevented. These deposits or buildups that are formed can on the one hand reduce the efficiency of the gasification, and on the other hand impair or disrupt the mentioned operation of the gasification device. In particular, the movement can be designed as a rotational movement, for example, about the longitudinal axis of the gasification device, especially when the gasification device is designed as a shaft gasifier. However, other forms of movement are also conceivable, such as translatory movements. The form of movement can be a continuous movement in one direction, on the one hand, but also in certain applications in departure from this, reciprocating or back and forth forms of movement with a regular reversal of the direction of movement are advantageous.

In the event that an air supply pipe is provided, the walls or wall segments are mechanically coupled to the air supply pipe for the transmission of a motion, especially a rotary motion, and preferably an actuator is provided that is coupled with the air supply pipe for introducing the movement or the rotary movement. Thanks to this mechanical coupling, an effective and reliable transmission of the motion to the wall or walls that define or bound off the oxidation zone is accomplished. In particular, the air supply pipe can accomplish both a translatory direction of movement, such as in the longitudinal direction of a gasification device designed as a shaft gasifier, or a rotary movement, say, about the longitudinal axis of a gasification device designed as a shaft gasifier, or a form of movement that is combined from these.

It is even more preferred to arrange one or more scoop elements on one or more walls of the oxidation chamber, which extend from the walls into the gasification zone and are configured to produce a conveying, comminuting or mixing movement in the solid in the gasification zone by movement of the wall or the wall segment to which they are attached. Such scoop elements, which can be designed, for example, as paddles, rods, wings, with or without a twisting, bring about a mixing and optionally a comminution and/or conveying in the region of the solid in which they extend when they are moving relative to it. For this purpose, the scoop elements can be arranged on the same level or staggered from each other, for example, along a helix on the outer surface of the walls bounding off the oxidation zone, and arranged in particular circumferentially about a longitudinal axis of a gasification device configured as a shaft gasifier. Such scoop elements, both during a translatory or also especially during a rotating movement of the wall element or the wall/walls to which they are attached, can contribute to a more homogeneous composition of the solids in the region of the gasification zone and thus achieve a more efficient gasification.

Even more preferably, the gasification device of the invention is modified by a reduction zone, which is connected to the oxidation zone to conduct the crude gas formed in the oxidation zone and designed to reduce the crude gas supplied to it. In the reduction zone, a burnable gas can be produced from the pyrolysis gas prepared in the oxidation zone, especially with the help of coke that is delivered from the gasification zone into the reduction zone and which consists of degasified solid residues. Furthermore, in this case a filtering of solid components can be achieved through the coke in the reduction zone. Alternatively or additionally, however, other methods can also be provided for the filtering, for example, by means of filter candles or the like.

Even more preferably the gasification device of the invention is modified in that it comprises: an arrangement of the gasification zone and the oxidation zone in a shaft gasifier, which has a fill opening arranged at the top end for the filling of the solid to be gasified, the gasification zone is arranged beneath the fill opening, and the gasification zone is at least partially annular in configuration and surrounds the oxidation zone, while the oxidation zone is arranged preferably centrally in relation to the cross section of the shaft gasifier and an air supply pipe or the air supply pipe starts from the oxidation zone and extends along the longitudinal axis of the shaft gasifier and is rotatably mounted for the transmission of a rotary movement to a wall bounding off the oxidation zone or several walls bounding off the oxidation zone.

With the gasification device so modified, a shaft gasifier is produced in which a gasification zone and an oxidation zone are arranged in adjacent position to each other, so that the oxidation zone is configured as a central oxidation chamber and is surrounded by the gasification zone and consequently separated from an outer wall of the shaft gasifier serving as a housing. In particular, the shaft gasifier can be cylindrical, i.e., round in cross section, which lets one form an annular gasification zone therein, bounded by round side walls. In other embodiments, however, other geometrical configurations of the shaft gasifier are advantageous, for example, with a square or rectangular cross section; in this case, the annular gasification zone is defined by appropriately configured and contiguous slot segments between the outer wall of the shaft gasifier forming the housing and the walls bounding the oxidation zone. Basically, it is to be understood here that a delivery of the solids is realized in the shaft gasifier that is brought about by gravity, especially solely by gravity, from an upper fill opening for fresh, nongasified material and a lower exit opening for degasified material (coke), wherein a local mixing or conveying of the solid by scoop elements, as described above, in the direction of gravity or against this direction is also included in the invention and is what is meant by a general conveying of the solid produced by gravity.

The embodiment as a shaft gasifier by this modification can be modified in particular with the above explained features, such as the air supply pipe, the sheathing pipe arranged to supply air to the interior region of the gasification zone and/or the division of the gasification zone into several gasification sectors with a corresponding temperature metering unit, control unit and air supply device. It is to be understood that the embodiment as a shaft gasifier is especially suitable to be modified in isolated manner or combined manner with the modifications as defined in the characterizing passage of claims 1 and/or 3 and/or 5, and corresponding modifications according to the other subclaims can also be provided here.

In the above-described embodiment as a shaft gasifier, it is especially preferred to provide a reduction zone, which is arranged underneath the gasification zone and makes possible a direct passage of solid from the gasification zone to the reduction zone and preferably a segment of the oxidation zone is arranged so that it separates the gasification zone in the direction of flow of the resulting gas from the reduction zone. In this reduction zone, as previously explained, a burnable gas can be produced from the pyrolyzed and oxidized or cracked crude gas and an additional filter effect can be accomplished.

It is furthermore preferred that the reduction zone is configured and arranged for the receiving of pyrolyzed solid from the gasification zone so that the pyrolyzed solid arrives in the reduction zone from the gasification zone by the action of gravity and a movable grill is arranged at the lower end of the reduction zone for the sifting of the ash falling down in the reduction zone. Furthermore, it is to be understood that the grill, on the one hand, can be moved in translation reciprocating or continuously rotating, in order to promote the falling of small coke and ash fractions into a chamber situated underneath, and on the other hand the grill can also be moved vertically so as to change the height of the reduction zone and make an adaptation to the course of the process or the solids that are supplied.

The gasification device of the invention can be further modified by a pressure metering device, which is configured to measure a pressure difference over at least a portion of the flow pathway of the produced gas inside the gasification device and coupled to a control device by signal technology, which is coupled by signal technology to an actuator for the movement of a grill, which when moved takes away fine fractions from the bulk solid pile inside the reduction zone to a collection space, the control device being configured to activate the actuator when a predetermined pressure difference is surpassed and preferably being designed to end the activating of the actuator when a lower, predetermined pressure difference is passed. With this modification, a pressure-dependent hauling away of the fine fractions in the bulk solid pile is accomplished and, thus, a more efficient operation is achieved. The pressure difference can be measured, in particular, along the entire flow path starting from the ambient air which enters the gasifier as fresh air and up to the exit opening for the finally prepared burnable gas from the gasifier.

This modification makes possible an operating mode in which a pressure difference is measured over at least a part of the flow pathway of the produced gas and a grill is moved by means of an actuator in order to take away fine fractions from the reduction zone when the measured pressure difference surpasses a predetermined value and preferably the movement of the grill is ended when the pressure difference passes below a smaller, predetermined value.

It is to be understood that this embodiment as a device or a method can also be realized independently of the division of the degasification zone into several sectors and the corresponding separate air supply devices and temperature metering devices and the corresponding process management.

Another aspect of the invention is a gasification process for production of an inflammable gas from a solid, with the steps:

- supplying of solid to a gasification zone,
- gasifying of the solid in the gasification zone by means of pyrolysis or gasification,
- supplying of the pyrolysis gas produced in the gasification zone to an oxidation zone,
- supplying of air to the oxidation zone and converting of the pyrolysis gas into a crude gas in a substoichiometric process by means of partial oxidation and cleavage in the oxidation zone,
- supplying of the crude gas from the oxidation zone to a reduction zone,
- supplying of partly or fully pyrolyzed solid to the reduction zone,
- reducing of the oxidized pyrolysis gas to a burnable gas in the reduction zone by means of the pyrolyzed solid, which is distinguished in that the gasification takes place in several gasification sectors of the gasification zone, the temperature of each gasification sector is measured and air is supplied to each gasification sector in a volume flow that depends on the particular temperature measured therein. The gasification method according to the invention can be implemented in particular with the above-explained gasification device and is distinguished in that an especially efficient gasification is achieved by an especially effective process control in the gasification zone, in that it is divided into individual process chambers in the form of gasification sectors and a separate temperature monitoring and control or regulation occurs in these gasification sectors.

Alternatively or additionally to this division of the gasification zone into gasification sectors, the gasification method can be modified in that the oxidation zone is arranged in a chamber that is bounded by one or more walls that are moved, in particular, rotated. Thanks to this movement, especially a rotation, the formation of deposits on the wall or walls of the oxidation chamber is prevented or at least reduced.

Furthermore, it is provided that scoop elements are arranged on the moving wall or walls, which extend into the gasification zone, and the solid is mechanically mixed, comminuted and/or stirred by means of the scoop elements. Thanks to such scoop elements, an effective blending of the solids is achieved in the region of the gasification zone and this makes the gasification more efficient.

Finally, as a further alternative to the partitioning of the gasification zone into several gasification sectors in the gasification method according to the invention, or in combination with this, and alternatively or in combination with the configuring of the oxidation zone with moving boundary walls, it is preferable for air to be supplied to the oxidation zone by an air supply pipe and for air to be supplied to the gasification zone by a sheathing pipe that surrounds the air supply pipe and the wall or walls of the oxidation zone are placed in rotation preferably by means of the air supply pipe. With this modification, an especially efficient air supply to the gasification zone is achieved in that not only, as provided in the prior art, does the air supply come from the outside across the outer walls of the gasification device, but in addition, an air supply also takes place from the inside and into the interior region of the gasification zone. Especially when the gasification zone is divided into several gasification sectors, it is to be understood that the sheathing pipe and the annular space formed by it between sheathing pipe and air supply pipe can be partitioned in order to supply the air to the individual gasification sectors in an individually regulated and independent manner and for this purpose it connects the individual circumferential segments of the annular space to a corresponding individually regulating air supply device. In this context, in particular, an appropriate individual detecting of the temperatures in the individual gasification sectors and a controlling/regulating of the air supply to the individual gasification sectors in dependence on these measured quantities can be done, it being understood that this individual air supply can occur, on the one hand, by the air supplied from the outside to the individual gasification sectors, and on the other hand, by the air supplied from the inside to the gasification sectors, or by both supply measures.

The invention will be explained more closely hereafter by preferred and non-limiting sample embodiments. There are shown:

FIG. 1 a lengthwise sectioned side view of a preferred embodiment of the gasification device according to the invention.

Figure 2:
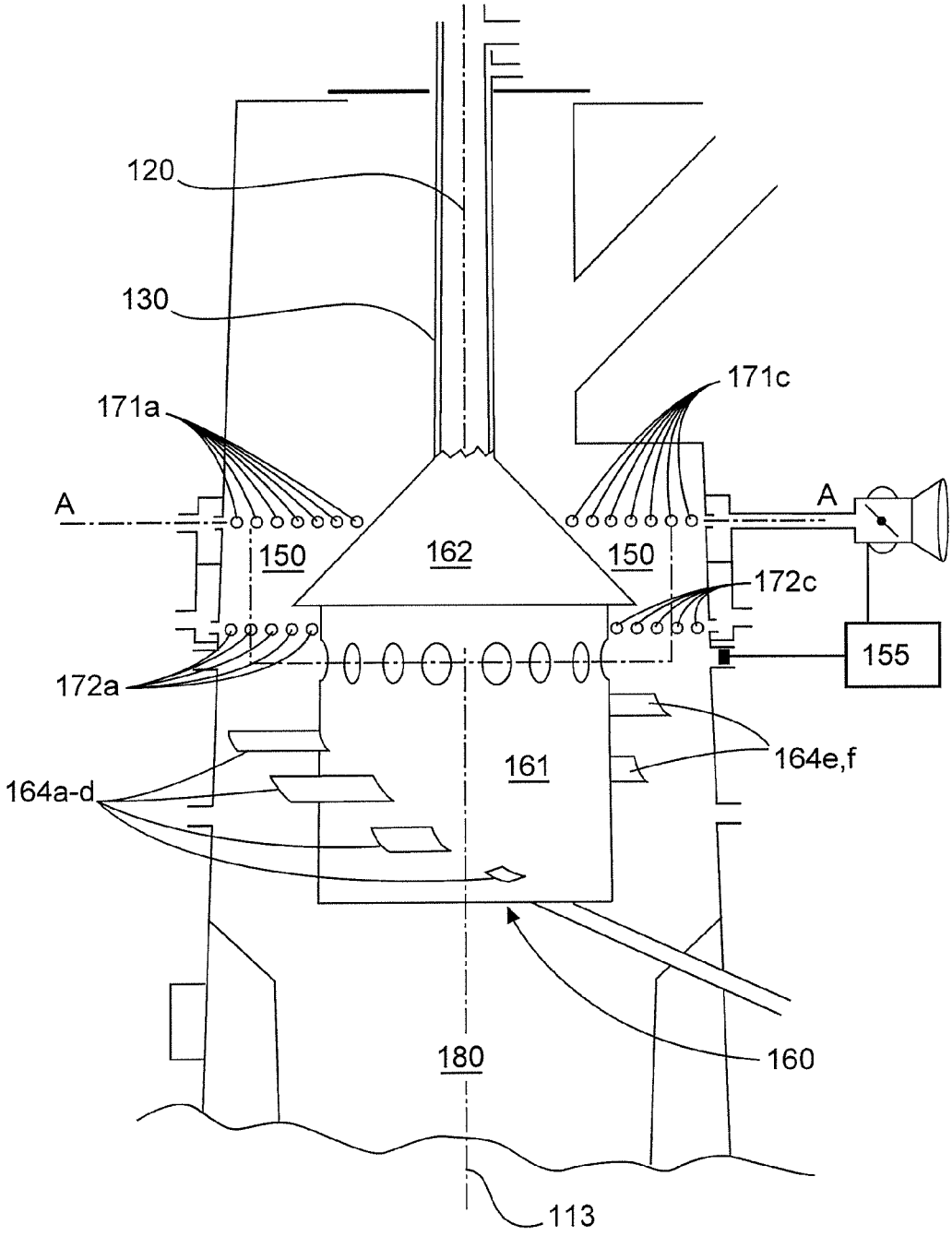
Figure 3:
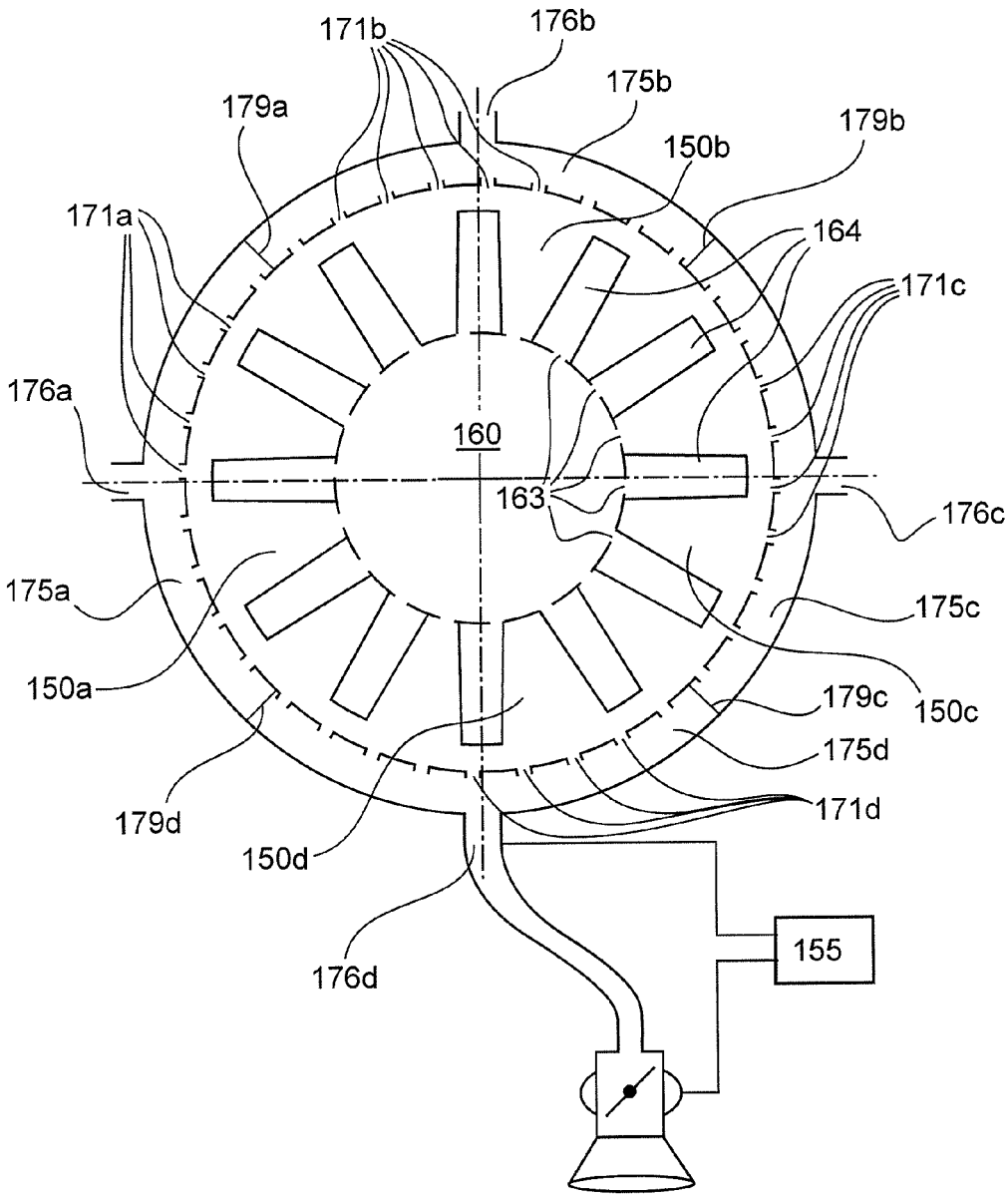

FIG. 2 a schematic, partially lengthwise-sectioned schematic side view of a detail of a second embodiment of the gasification device according to the invention, and FIG. 3 a schematic top view of a detail of the second embodiment of the gasification device according to the invention, transversely sectioned along line A-A in FIG. 2.

Referring first to FIG. 1, a shaft gasifier is shown, being bounded off from its surroundings by an essentially cylindrical housing 10 with an encircling housing wall. At the top end there is arranged a cover 11 and the top of the housing is closed with the exception of a central through opening 12. Through the opening 12 are led an air supply pipe 20 and a sheathing pipe 30 surrounding this air supply pipe. The air supply pipe 20 and the sheathing pipe 30 extend centrally in the longitudinal direction along the central longitudinal axis 13 of the gasifier.

A fill opening 40, which can be closed by means of a cover 41, and adjoining a slanting channel 42 that drops down from the top, in relation to the central longitudinal axis 13, is arranged in the upper region of the gasifier and serves to supply the solids. The channel 42 emerges into a gasification zone 50, in which solids are placed and subjected to a pyrolysis.

The gasification zone 50 is arranged between the outer wall 10 of the gasifier and a central oxidation chamber 60 and is separated by a cylindrical wall 61 from the oxidation zone 60. In this way, the gasification zone 50 has an annular configuration and encloses the oxidation zone 60 on all sides in one horizontal cross section.

In the gasification zone 50, air with an oxygen content is blown in via air entry nozzles 71*a,c* 72*a,c*, which extend in the radial direction to the central longitudinal axis 13 and are installed in the housing wall 10 in an encircling series. The air supply pipes 71*a,c* 72*a,c* are arranged in a total of two levels and distributed uniformly over the circumference of the gasifier.

The air entry nozzles 71*a,c* are surrounded by an annular channel 75*a, c*, placed on the housing 10 on the outside, through which the air is distributed circumferentially to all air entry nozzles. Air from the outside is introduced into the annular channel 75*a,c* through openings 76*a,c*. In like fashion, the air entry nozzles 72*a,c* are surrounded by an annular channel 77*a, c*, placed on the housing 10 on the outside, into which air can enter via openings 78*a, c* and by which the air is distributed circumferentially to all air entry nozzles 71*a,c* 72*a,c*.

Between the air supply pipe 20 and the sheathing pipe 30 there is formed an annular space 31, through which air is likewise led, being supplied across an air entry pipe 32 to the annular space 31 from an air source. From this annular space 31, the air goes into a total of four air pipes 33, 34 that are distributed about the periphery and staggered by 90° relative to each other, which extend radially outward from the annular space 31. From the air pipes 33, 34, the air emerges at the outer end and is deflected downward at a slant into the annular gasification zone 50. In this way, the gasification zone 50 on the one hand is supplied with air from the outside through the air entry nozzles 71*a,c*, 72*a,c* and on the other hand air is supplied from inside through the air pipes 33, 34, which leads to a uniform movement of air through the solids in the gasification zone 50.

Above the air pipes 33, 34, the oxidation zone 60 is covered by a conical housing segment 62, which falls down at a slant from the top, thereby facilitating the supply of solids from the supply channel 42 to the gasification zone 50 solely by gravity.

By means of temperature sensors that are installed in openings 51*a, c* and 52*a, c*, the temperature is measured in the gasification zone.

The pyrolysis gas produced by pyrolysis in the gasification zone 50 goes through openings 63 *a-d* that are distributed on one horizontal level circumferentially around a cylindrical housing wall 61 into the oxidation zone. In the oxidation zone, the crude gas is transformed substoichiometrically by partial oxidation and a thermal cracking into short carbon chains at a temperature of around 1000° C. or more. For this, air as oxidizing agent is supplied by the air supply pipe 20 to the oxidation zone via an air entry channel 21, emerging from several openings 22 distributed about the periphery at the lower end of the air supply pipe 20. An axial end opening 23 is arranged at the lower end of the air entry pipe, serving to accommodate an upper temperature sensor.

The solids pyrolyzed in the gasification zone 50 slide further downward by force of gravity and are delivered by outward and downward slanting conical baffles arranged at the inside bottom to an inwardly situated, cylindrically bounded reduction zone 80. This delivery as well occurs solely by the influence of gravity. The crude gas partially oxidized and thermally cracked in the oxidation zone is drawn off across an exit channel 90, which is installed in the housing wall 10 at the lower end of the gasifier. The overall gas flow management inside the gasifier is produced solely by a partial vacuum applied at the exit channel 90, by which the burnable gas is drawn off from the gasifier.

The temperature in the gasification zone is measured by means of temperature sensors, which are installed in openings 51*a, c*. A total of four openings 51*a-d* staggered by 90° are provided (the openings 51*b,d* lie outside the plane of section and cannot be seen or they are hidden by the oxidation zone). By means of the temperature sensors in the openings 51*a-d*, the temperature can be measured separately in the degasification sectors, as described more closely with FIG. 3.

By means of a temperature probe pipe 65, extending from the outside into the lower region of the oxidation zone 60 separated from the air supply by the air supply pipe 20, one can measure with a temperature probe the temperature in the oxidation zone. The temperature so measured constitutes a dependable value for the process temperature in the oxidation zone and is used as an input variable for the control/regulation of the supply of oxidizing agent, i.e., air, by means of a control device to the oxidation zone.

On its travel from the oxidation zone 60 to the exit pipe 90, the partially oxidized and thermally cracked crude gas flows through the coke located on top of a grill 100, which is formed from the solid gasified in the gasification zone 50 and drops downward. In this way, the crude gas is led through the fully degasified coke collected on the grill 100 and filtered and chemically reduced in this process. The crude gas then finally drawn off through the opening 90 is consequently of high quality and extremely low in tar.

The grill 100 is moved by means of rollers 101 for a translatory reciprocating motion and can be coupled to an appropriate actuator by means of a rod 102. The movement of the grill brings about a fall-through of fine ash residue and particles into a collecting space 103. The grill movement is controlled in dependence on a pressure difference. The pressure difference is calculated from the partial vacuum at the exit channel 90 and from the ambient pressure. If a predetermined pressure difference is surpassed, a movement of the grill is produced, until the pressure difference has dropped below a predetermined lower value.

FIG. 2 shows a segment of a second embodiment. One recognizes an oxidation zone 160, which is bounded by a cylindrical wall 161. As in the first embodiment, the oxidation zone 160 is bounded at its upper end by a conical housing wall 162, in which an air supply pipe 120 and a sheathing pipe 130 surrounding it are installed. In this case as well, the air supply pipe and the sheathing pipe are rotatably mounted and can turn about the longitudinal axis 113 of the gasifier. In this way, both the housing wall 162 and the housing wall 161 are placed in rotation about the central longitudinal axis 113, which prevents a buildup of pyrolysis gas components and the formation of layers built up on these walls.

Furthermore, several scoops 164 *a-f* are fastened on the cylindrical housing wall 161. Each scoop 164 *a-f* extends from the housing wall 161 radially outward and therefore passes through the gasification zone. The scoops 164 *a-f* are vertically staggered relative to each other along a helical line and fastened on the housing wall 161. Upon rotation of the housing 161, the scoops 164 *a-f* bring about a mixing and loosening by means of an upward delivery of the solid situated in their vicinity into the gasification zone and thereby produce a homogeneous and efficient gasification of this solid.

The air entry nozzles 171*a, c*, 172*a,c* are arranged above the level in which the uppermost scoops 164*a-f* lie and supply air from the outside to the gasification zone. In addition, as already described above, air is supplied from the inside via the annular space between sheathing pipe 130 and air supply pipe 120.

In FIG. 3 a horizontal cross section through the gasifier is shown at the height of the openings in the oxidation chamber wall 61 or 161 and the air entry nozzles 171*a,c*. As can be seen from FIG. 3, air enters the gasification zone 150*a-d* from an annular channel 175 *a-d* through a plurality of openings 171*a-d* formed radially in the housing wall 110.

The annular channel is divided into four annular channel sectors 175*a-d* by means of radially extending partition walls 179*a-d*, which are spaced from each other in the circumferential direction by 90°. Air can enter each annular channel sector 175*a-d* via an air entry opening 176*a-d* and this air supply can be controlled individually in terms of its quantity for each annular channel sector 175*a-d*.

From the annular channel sectors 175*a-d*, the air enters the gasification zone through air entry nozzles 171*a-d* coordinated with each annular channel sector. In this way, a functional separation of the gasification zone into four gasification sectors 150*a-d* is produced in terms of the air supply and, consequently, the temperature management. In each gasification sector the temperature is individually measured and the air supply is appropriately controlled or regulated. Depending on such measured temperature, a control device 155 individually regulates the air supply to each gasification sector by a corresponding throttle. When the temperature is too low for an optimal pyrolysis, the air supply in increased; when the temperature is too high for an optimal pyrolysis, the air supply is throttled. It is to be understood that a separate temperature metering probe and a separately controlled air supply device is provided for each separately controlled gasification sector. The control/regulation can be done by individual or shared electronic controllers/regulators.

From the gasification sectors 150*a-d*, the pyrolysis gas goes through openings 163 into the central oxidation zone 160 and here it is transformed by a partial oxidation and thermal cracking. From here, the crude gas goes down into the reduction zone and is drawn off from the gasifier by the exit pipe.

The invention claimed is:

1. A gasification device for the creation of a flammable gas from a solid, comprising:

a gasification zone in which the solid can be filled through a fill opening to form a gas;

an oxidation zone for the oxidation of the gas, which is connected to the gasification zone to conduct the gas created in the gasification zone into the oxidation zone, wherein the oxidation zone is surrounded at least partly by the gasification zone, wherein the gasification zone is divided into several neighboring gasification sectors that are distributed about a periphery of the gasification zone; and a temperature metering unit configured to measure the temperature prevailing in each gasification sector, the temperature metering unit being coupled by signal technology to a control unit, which is coupled to an air supply device by signal technology that is designed to supply air individually to each gasification sector, and the amount of air supplied to each gasification sector per unit of time is dependent on the temperature measured therein.

2. The gasification device according to claim 1 further comprising an air supply pipe connected at a first end to the oxidation zone so as to protrude into the oxidation zone, and connected by an opposite end to a source of oxygen-containing air.

3. The gasification device according to claim 2, wherein the air supply pipe is arranged at least partially in a sheathing pipe and an annular space is formed between the air supply pipe and the sheathing pipe.

4. The gasification device according to claim 1, wherein the oxidation zone is arranged in an oxidation chamber, which is bounded by one or more walls from the gasification zone, and at least segments of these walls are movable in relation to the gasification zone.

5. The gasification device according to claim 4, wherein the movable walls are adapted to rotate.

6. The gasification device according to claim 2, wherein the walls are mechanically coupled to the air supply pipe for the transmission of a motion, and an actuator is provided that is coupled with the air supply pipe for introducing air movement or rotary movement.

7. The gasification device according to claim 4 further comprising at least one scoop element arranged on the one or more walls of the oxidation chamber, and extending from the walls into the gasification zone, the at least one scoop element configured to produce a conveying or mixing movement in the solid in the gasification zone by movement of the wall or the wall segment to which the at least one scoop element is attached.

8. The gasification device according to claim 1 further comprising a reduction zone connected to the oxidation zone to conduct the gas formed in the oxidation zone and designed to reduce the gas supplied to it.

9. The gasification device according to claim 1, wherein the gasification zone and the oxidation zone are arranged as a shaft gasifier which has a fill opening arranged at the top end for the filling of the solid to be gasified, the gasification zone is arranged beneath the fill opening, and the gasification zone is at least partially annular in configuration and surrounds the oxidation zone, and wherein the oxidation zone is arranged preferably centrally in relation to the cross section of the shaft gasifier and an air supply pipe or the air supply pipe starts from the oxidation zone and extends along the longitudinal axis of the shaft gasifier and is rotatably mounted for the transmission of a rotary movement to at least one wall bounding off the oxidation zone.

10. The gasification device according to claim 9, wherein a reduction zone is arranged underneath the gasification zone and is in communication with it for the direct passage of solid from the gasification zone to the reduction zone and wherein a segment of the oxidation zone is arranged so that it separates the gasification zone from the reduction zone in the direction of flow of the resulting gas.

11. The gasification device according to claim 10, wherein the reduction zone is configured and arranged to receive a pyrolyzed solid from the gasification zone so that the pyrolyzed solid arrives in the reduction zone from the gasification zone by the action of gravity and a movable grill is arranged at the lower end of the reduction zone for the sifting of the ash falling down in the reduction zone.

12. The gasification device according to claim 1 further comprising a pressure metering device configured to measure a pressure difference over at least a portion of the flow pathway of the produced gas inside the gasification device and coupled to a control device by signal technology, which is coupled by signal technology to an actuator for the movement of a grill, which when moved, takes away fine fractions from the bulk solid pile inside the reduction zone to a collection space, the control device being configured to activate the actuator when a predetermined pressure difference is surpassed and configured to end the activating of the actuator when a lower, predetermined pressure difference is passed.

* * * * *